US008132296B2

(12) United States Patent
Di Nicolantonio

(10) Patent No.: US 8,132,296 B2
(45) Date of Patent: Mar. 13, 2012

(54) AUXILIARY HANDLE DEVICE

(75) Inventor: Aldo Di Nicolantonio, Recherswil (CH)

(73) Assignee: Robert Bosch GmbH, Stuttgart (DE)

( * ) Notice: Subject to any disclaimer, the term of this patent is extended or adjusted under 35 U.S.C. 154(b) by 438 days.

(21) Appl. No.: 12/439,391

(22) PCT Filed: Jul. 12, 2007

(86) PCT No.: PCT/EP2007/057148

§ 371 (c)(1),
(2), (4) Date: Feb. 27, 2009

(87) PCT Pub. No.: WO2008/025605

PCT Pub. Date: Mar. 6, 2008

(65) Prior Publication Data

US 2010/0005629 A1 Jan. 14, 2010

(30) Foreign Application Priority Data

Sep. 1, 2006 (DE) ..... 10 2006 041 069

(51) Int. Cl.
*A45C 13/26* (2006.01)

(52) U.S. Cl. ..... 16/426

(58) Field of Classification Search ..... 16/426, 16/408, 429, 436; 294/58; 408/124, 241 R; 173/161, 162.1, 162.2; 81/177.6, 177.7, 81/177.8, 177.9
See application file for complete search history.

(56) References Cited

U.S. PATENT DOCUMENTS 2,843,413 A * 7/1958 Martin ..... 292/348
3,537,336 A * 11/1970 Schmuck ..... 408/72 R
4,276,675 A * 7/1981 Pioch ..... 16/426
4,460,296 A * 7/1984 Sivertson, Jr. ..... 408/124
4,504,087 A * 3/1985 Pennington ..... 292/347
4,820,090 A * 4/1989 Chen ..... 408/241 R
4,881,294 A * 11/1989 Riedl ..... 16/426
4,891,915 A 1/1990 Yasuda
5,288,116 A * 2/1994 Donofrio ..... 292/336.3
6,241,594 B1 * 6/2001 Lepold ..... 451/359
6,499,219 B1 * 12/2002 Wightman ..... 33/334
2002/0125022 A1 9/2002 Dieterle et al.
2002/0131834 A1 9/2002 Lui et al.
2002/0132570 A1 9/2002 Berg et al.
2004/0163214 A1 8/2004 Cheng
2005/0034276 A1 2/2005 Badiali
2005/0081364 A1 4/2005 Kopras et al.
2005/0082072 A1 * 4/2005 Nicolantonio et al. .... 173/162.2
2005/0262707 A1 12/2005 Wu
2006/0067801 A1 3/2006 Van Bergen
2007/0022595 A1 2/2007 Kopras et al.
2007/0209162 A1 * 9/2007 McRoberts et al. ..... 16/426

FOREIGN PATENT DOCUMENTS

CH 649733 A5 6/1985
DE 10106050 A1 8/2002
DE 202004020217 U1 5/2005
EP 0249037 A2 12/1987
EP 0791436 A1 8/1997

* cited by examiner

*Primary Examiner* — Chuck Y. Mah
(74) *Attorney, Agent, or Firm* — Ronald E. Greigg

(57) ABSTRACT

The invention is based on an auxiliary handle device, in particular for hand-held power tools, comprising a fastening unit which comprises at least one fastening mechanism. It is proposed that the fastening mechanism is provided in an axial direction of a fastening axis in order to achieve a positive connection.

9 Claims, 4 Drawing Sheets

AUXILIARY HANDLE DEVICE

CROSS-REFERENCE TO RELATED APPLICATION

This application is a 35 USC 371 application of PCT/EP 2007/057148 filed Jul. 12, 2007.

BACKGROUND OF THE INVENTION

1. Field of the Invention

The invention is based on an auxiliary handle device.

2. Description of the Prior Art

The invention is based on an auxiliary handle device, in particular for hand-held power tools, with an attaching device that has at least one fastening mechanism.

SUMMARY OF THE INVENTION

The invention is based on an auxiliary handle device, in particular for hand-held power tools, with an attaching device that has at least one fastening means.

According to one proposal, the fastening mechanism is provided for producing a form-locked connection in an axial direction of a fastening axis, thus achieving an efficient securing of an auxiliary handle in the axial direction. This advantageously prevents the auxiliary handle from slipping in the axial direction, for example in the event that a tool jams during operation of the hand-held power tool. The auxiliary handle device is particularly provided for the fastening of the auxiliary handle to a hand-held power tool such as a drilling and/or hammering hand-held power tool, e.g. an impact drill, so that the fastening axis of the fastening device corresponds to a tool axis of the hand-held power tool, in particular a drilling axis. In this context, an "axial direction of a fastening axis" is understood to be a direction along the fastening axis.

According to another proposal, the fastening device has at least one additional fastening mechanism for producing a form-locked connection in a circumference direction of the fastening axis, thus making it possible, in addition to a securing of an auxiliary handle to a hand-held power tool in the axial direction of the fastening axis, to also achieve a securing of the auxiliary handle in the circumference direction of the fastening axis. The fastening mechanism for producing the form-locked connection in the circumference direction of the fastening axis is situated and/or embodied in a location or way that differs from that of the fastening mechanism for producing the form-locked connection in the axial direction of the fastening axis. A "circumference direction of the fastening axis" is understood here to be a direction that is oriented around the fastening axis.

According to another proposal, the fastening mechanism for producing a form-locked connection in the axial direction of the fastening axis has a rib-shaped fastening element that makes it possible to achieve a rugged fastening mechanism and an efficient securing of an auxiliary handle in the axial direction. Preferably, a main extension direction of the rib-shaped fastening element is oriented perpendicular to the fastening axis so that it is possible to achieve a maximal securing and/or fastening area for the securing in the axial direction. In this instance, the rib-shaped fastening element can be situated in a receiving region of the auxiliary handle or can be coupled to a component of the hand-held power tool provided for the fastening of the auxiliary handle. In addition, the rib-shaped fastening element can be constituted by a pin-shaped or rod-shaped component, a stamped sheet metal component, or other components deemed suitable by those skilled in the art.

According to another proposal, the rib-shaped fastening element is situated inside an auxiliary handle, thus making it possible to achieve a convenient mounting of the auxiliary handle, in particular a play-free mounting. In addition, it is advantageously possible to save on additional components, space, assembly complexity, and costs if the rib-shaped fastening element is embodied as integrally joined to the auxiliary handle. The rib-shaped fastening element in this instance can be press-fitted into the auxiliary handle, injection-molded into it, or fastened to the auxiliary handle in another way deemed suitable by those skilled in the art.

For producing a form-locked connection in the axial direction of the fastening axis, the fastening mechanism advantageously has a groove-shaped recess that makes it possible to achieve a simple and in particular tool-free detent engagement of a fastening mechanism that corresponds to it. Preferably, a main extension direction of the groove-shaped recess is oriented perpendicular to the fastening axis. In particular, the groove-shaped recess can extend in the circumference direction of the fastening axis.

In addition, a particularly compact embodiment of a hand-held power tool can be achieved if the groove-shaped recess is situated in a spindle neck of the hand-held power tool. By means of a fastening mechanism that corresponds to the groove-shaped recess and is situated on the auxiliary handle, e.g. a rib-shaped fastening element, it is also possible, through the addition of a detent mechanism of the fastening mechanism, to produce a haptic feeling of safety for an operator of the hand-held power tool.

It is possible to achieve a rugged securing if the fastening mechanism for producing a form-locked connection in the circumference direction of the fastening axis has at least one raised area. The raised area can be situated on an auxiliary handle or on a component of a hand-held power tool that is provided for the fastening of the auxiliary handle.

An attachment of the auxiliary handle that is particularly convenient and easy for an operator of the hand-held power tool can be achieved if the raised area is situated on a spindle neck of the hand-held power tool. In this case, the raised area is suitably embodied as integrally joined to the spindle neck of the hand-held power tool, thus enabling savings on additional components, space, assembly complexity, and costs. In a particularly advantageous embodiment, the raised area is bar-shaped and is coupled to a housing of the hand-held power tool.

The fastening mechanism for producing a form-locked connection in the circumference direction of the fastening axis advantageously has at least one recess, thus making it possible to achieve a simple, form-locked securing to corresponding fastening mechanism, e.g. raised areas, in the circumference direction. In this case, the fastening mechanism with the recesses can be situated on a component of a hand-held power tool that is provided for the fastening of the auxiliary handle and in a particularly advantageous embodiment, can be situated on an auxiliary handle.

According to a proposal in another embodiment of the invention, the auxiliary handle device has a receiving device of an auxiliary handle that is composed of at least two parts, thus making it possible to achieve a particularly convenient, structurally simple attachment of the auxiliary handle to a hand-held power tool, in particular to a spindle neck of an impact drill. In addition, a particularly advantageous play-free insertion of the spindle neck into the receiving device can be achieved in that one part of the receiving device is provided for the axial securing and another part of the receiving device is provided for the insertion. In this context, a "receiving device" is understood to be a device of an auxiliary handle that is provided for receiving a subregion of a hand-held power tool, in particular a spindle neck.

According to another proposal, the auxiliary handle device includes a first and second component of the auxiliary handle, which engage with each other in the assembled state. This makes it possible to achieve a particularly stable receiving device of the auxiliary handle and to achieve a stable, secure attachment to the hand-held power tool.

According to a particularly advantageous embodiment, this can be achieved in a structurally simple fashion if at least one subregion of one of the components of the auxiliary handle is embodied as slot-like. Preferably, a slot-like embodiment of one of the components is oriented perpendicular to the fastening axis.

A structurally simple, form-locked reciprocal engagement of the two components of the receiving region of the auxiliary handle can be achieved if at least one subregion of a component of the auxiliary handle has a cavity. In this context, a "cavity" is understood to be a hollow space that is situated on the interior of the component and is open to the outside at a maximum of two sides.

BRIEF DESCRIPTION OF THE DRAWINGS

Other advantages ensue from the following description taken in conjunction with the drawings, in which.

DESCRIPTION OF THE PREFERRED EMBODIMENTS

Figure 1:
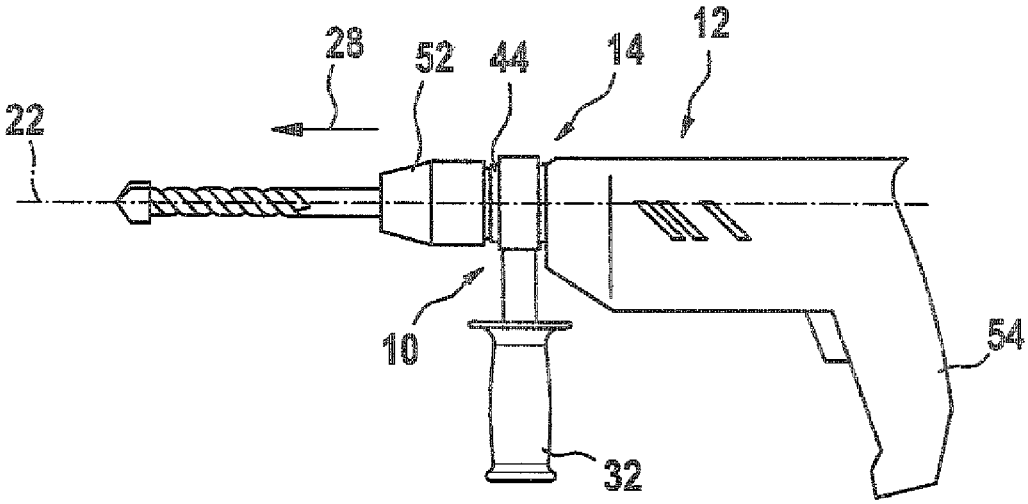
FIG. 1 shows a hand-held power tool with an auxiliary handle device.

FIG. 1 shows a hand-held power tool 12 embodied in the form of a drilling and/or impact drilling machine. The hand-held power tool 12 includes a tool holder 52 that can be driven by means of a drive unit, not shown in detail, and a main handle 54 situated at the end of the hand-held power tool 12 oriented away from the tool holder 52. An auxiliary handle 32 is situated before the tool holder 52 in the axial direction 28, along a drilling axis 22 of the hand-held power tool 12. The auxiliary handle 32 is situated on a spindle neck 44 of the hand-held power tool 12. The auxiliary handle 32 can be fastened to the spindle neck 44 of the hand-held power tool 12 by means of an auxiliary handle device 10 that includes a fastening device 14.

Figure 2:
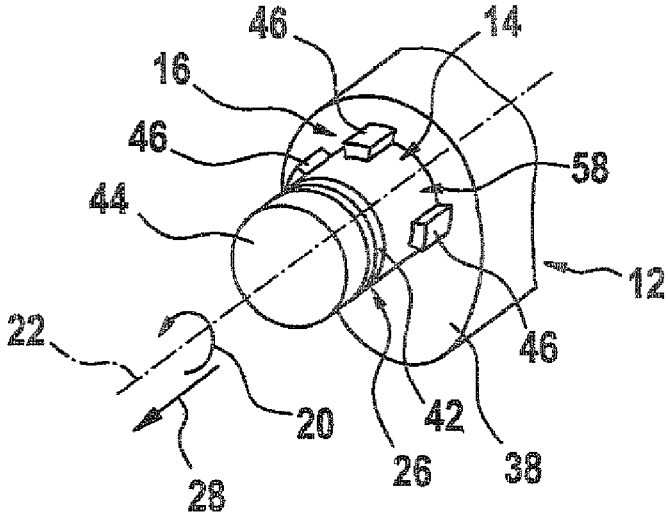
FIG. 2 shows a spindle neck of the hand-held power tool from FIG. 1.

FIG. 2 shows a partial section through the drilling and/or impact drilling machine shown in FIG. 1, with the spindle neck 44 for accommodating the auxiliary handle 32. The spindle neck 44 has a cylinder-like form and is oriented along the drilling axis 22 of the drilling and/or impact drilling machine. The fastening axis corresponds to the drilling axis 22 of the drilling and/or impact drilling machine. The fastening device 14 is situated on the spindle neck 44, which has a fastening means 16 for producing a form-locked connection in the circumference direction 20 of the fastening axis and another fastening means 26 for producing a form-locked connection in the axial direction 28 of the fastening axis. The fastening means 16 for producing the form-locked connection in the circumference direction 20 has four bar-shaped raised areas 46 that are distributed around the spindle neck 44 in the circumference direction 20. The four bar-shaped raised areas 46 are spaced apart from one another by 90° in the circumference direction 20 and are integrally joined to the spindle neck 44. In addition, the bar-shaped raised areas 46 are situated on an edge region 58 of the spindle neck 44 that is oriented away from the tool holder 52 and situated adjacent to a housing 38 of the hand-held power tool 12.

The fastening means 26 for producing the form-locked connection in the axial direction 28 of the fastening axis has a groove shaped recess 42 that extends in the circumference direction 20 around the spindle neck 44 of the hand-held power tool 12. The groove-shaped recess 42 extends in an annular fashion around the entire spindle neck 44. It is also essentially conceivable, though, for the groove-shaped recess 42 to extend over a limited partial region in the circumference direction 20 on the spindle neck 44. In the direction toward the tool holder 52 along the fastening axis, the groove-shaped recess 42 is situated after the four bar-shaped raised areas 46. The groove-shaped recess 42 is also spaced apart from the four bar-shaped raised areas 46 on the spindle neck 44.

Figure 3:
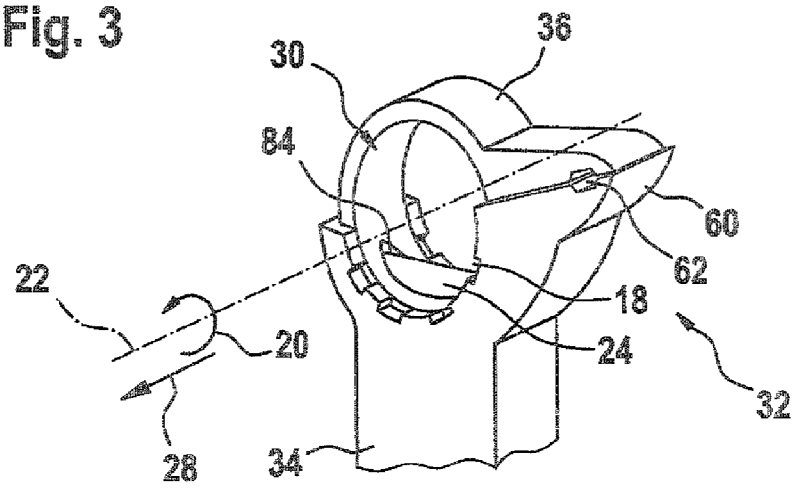
FIG. 3 is a partial section through the auxiliary handle from FIG. 1 with a receiving device composed of two parts.

FIG. 3 shows a partial section through the auxiliary handle 32. The auxiliary handle 32 includes a receiving device 30, which is composed of two parts, and the fastening device 14 of the auxiliary handle device 10, which has a fastening means 18 for producing the form-locked connection in the circumference direction 20 of the fastening axis and a fastening means 24 for producing a form-locked connection in the axial direction 28 of the fastening axis.

Figure 4:
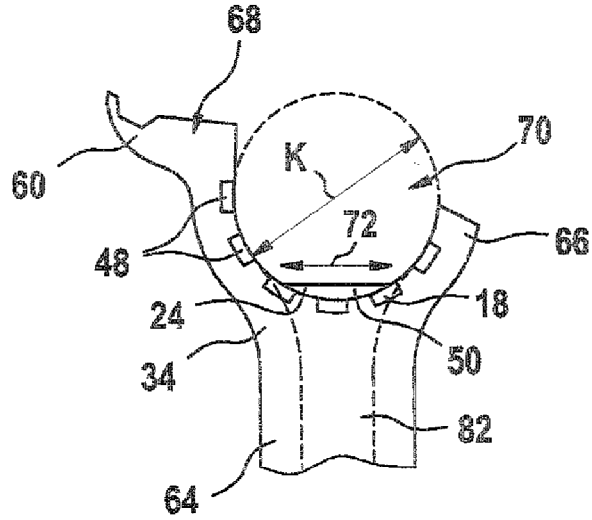
FIG. 4 shows a first component of the receiving device from FIG. 3.

A first component 34 of the auxiliary handle 32 includes a handle element 64 and a semicircular receiving element 66 of the receiving device 30 for receiving the spindle neck 44 of the drilling and/or impact drilling machine (FIG. 4). The receiving element 66 is integrally joined to the handle element 64 and is open at an end oriented away from the handle element 64. An edge region 68 of the semicircular receiving element 66 is adjoined by a molded region 60 for accommodating the measuring device. The receiving element 66 here encompasses a receiving region 70 with a diameter K in a semicircular fashion.

The receiving element 66 of the first component 34 is equipped with the fastening means 18 in order to secure the auxiliary handle 32 to the spindle neck 44 of the drilling and/or impact drilling machine in the circumference direction 20 of the fastening axis. The fastening means 18 is composed of recesses 48 spaced uniformly apart from one another, which are arranged in the circumference direction 20 on a side of the receiving element 66 oriented toward the receiving region 70. The recesses 48 here extend along the fastening axis on a subregion of the semicircular receiving element 66. In order to secure the auxiliary handle 32 in the axial direction 28 of the fastening axis, the receiving element 66 is equipped with the fastening means 24 for producing a form-locked connection in the axial direction 28 of the fastening axis, which fastening means 24 is constituted by a rib-shaped fastening element 50 and is press-fitted into the receiving element 66. In this case, the rib-shaped fastening element 50, which is embodied in the form of a pin, protrudes into the semicircular receiving region 70 of the receiving element 66. A main extension direction 72 of the rib-shaped fastening element 50 is oriented perpendicular to the fastening axis (FIG. 4).

Figure 5:
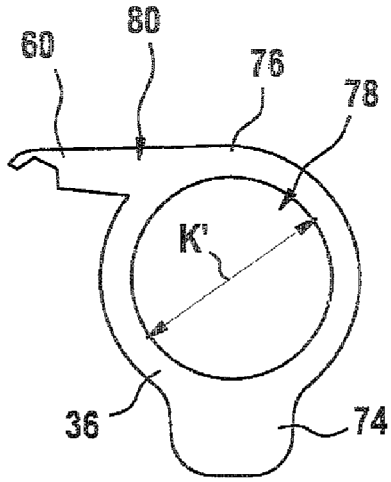
FIG. 5 shows a second component of the receiving device from FIG. 3.

As shown in FIG. 5, a second component 36 has a subregion 74, which is provided for engaging in the first component 34, and a circular receiving element 76 for accommodating the spindle neck 44 of the drilling and/or impact drilling machine. The subregion 74 and the circular receiving element 76 here are embodied as integrally joined to each other. The receiving element 76 forms a circular receiving region 78 with a diameter K' that is equal to the diameter K of the first component 34. The molded region 60 for accommodating the measuring device is situated in an edge region 80 of the receiving element 76, opposite from the subregion 74.

On the lateral molded region 60, 61 of the first component 34 and of the second component 36, respectively, the auxiliary handle 32 also has a receiving region 62 for a measuring device that is not shown in detail, which is provided for measuring and/or detecting a drilling hole depth in a drilling procedure carried out with the drilling and/or impact drilling machine (FIG. 3). The measuring device here is advantageously affixed to the auxiliary handle 32 with a form-locked assembly of a first component 34 and second component 36 of the auxiliary handle 32 (FIGS. 6 and 7).

Figure 6:
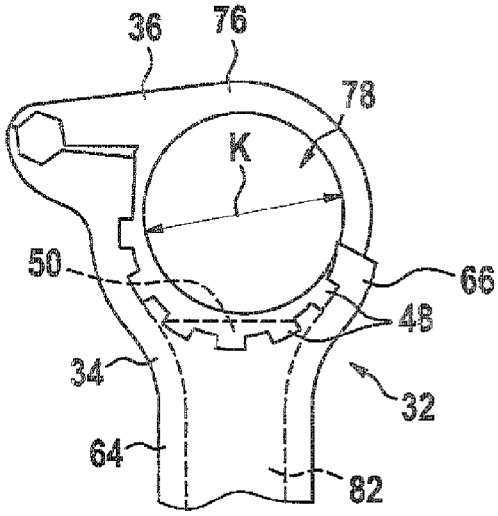
FIG. 6 shows the auxiliary handle in an open state.
Figure 7:
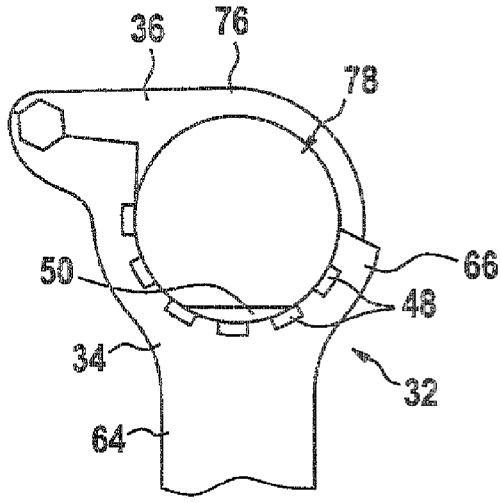
FIG. 7 shows the auxiliary handle in a closed state.

FIGS. 6 and 7 show the form-locked reciprocal engagement of the first component 34 and the second component 36 of the auxiliary handle 32. To this end, a subregion encompassed by the handle element 64 of the first component 34 is provided on the inside with a cavity 82 that is provided for accommodating the second component 36 (FIGS. 4 and 6). The second component 36 is embodied as slot-shaped in the subregion 74, in a region of the receiving element 76 oriented toward the subregion 74 (FIG. 3) so as to enable a form-locked engagement in the first component 34. A slotted region 84 (FIG. 3) of the second component 36 is oriented perpendicular to the fastening axis. When all auxiliary handle 32 is mounted onto the spindle neck 44 of the drilling and/or impact drilling machine, the second component 36 is inserted perpendicular to the fastening axis with the subregion 74 at the front, into the semicircular receiving region 70 and then into the cavity 82 of the first component 34 depicted with dashed lines in FIG. 6. In this case, the second component 36 is inserted into the first component 34 far enough that an essentially complete circular diameter K' of the second component 36 remains (FIG. 6). The circular diameter K' of the receiving region 78 is matched to a cross section of the spindle neck 44 so that the auxiliary handle 32 can be guided onto the spindle neck 44 virtually without play. In order to hold the second component 36 in position relative to the first component 34 while the auxiliary handle 32 is being guided into place, the first component 34 and the second component 36 are screwed to each other by means of a screw connection that is not show in detail. The auxiliary handle 32 with the first component 34 and the second component 36 is guided with the side with the recesses 48 toward the front, past the tool holder 52 onto the spindle neck 44 until the recess 48 and the bar-shaped raised areas 46 come into form-locked engagement with each other. To this end, the second component 36 is embodied as shorter than the first component 34 by the span length of the recesses 48 in the axial direction 28 (FIG. 3). The auxiliary handle 32 here can be attached in different radial orientations by means of the four bar-shaped raised areas 46 on the spindle neck 44 and the recesses 48 on the auxiliary handle 32. Then the first component 34 and the second component 36 are clamped to each other by means of the screw connection so that the rib-shaped fastening element 50 engages in a form-locked fashion in the groove-shaped recess 42 provided for it in the spindle neck 44 while the first component 34 and second component 36 are connected to each other in a form-locked fashion (FIG. 7). In order to detach the auxiliary handle 32, the screw connection is loosened until the rib-shaped fastening element 50 is freed from the groove-shaped recess 42 so that the auxiliary handle 32 can first be slid axially and can then be shifted as needed in the circumference direction 20.

Figure 8:
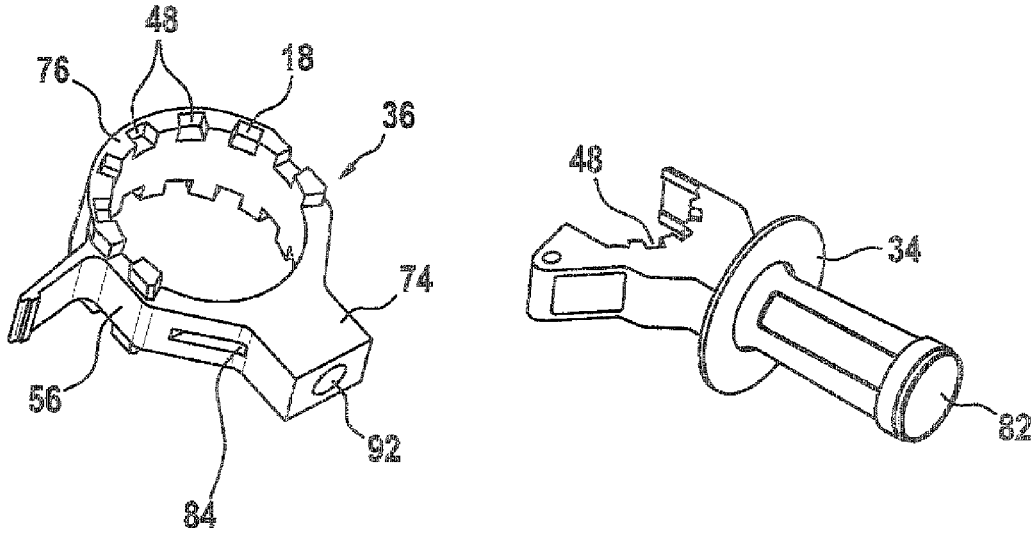
FIG. 8 shows an exploded view of an alternative auxiliary handle.
Figure 9:
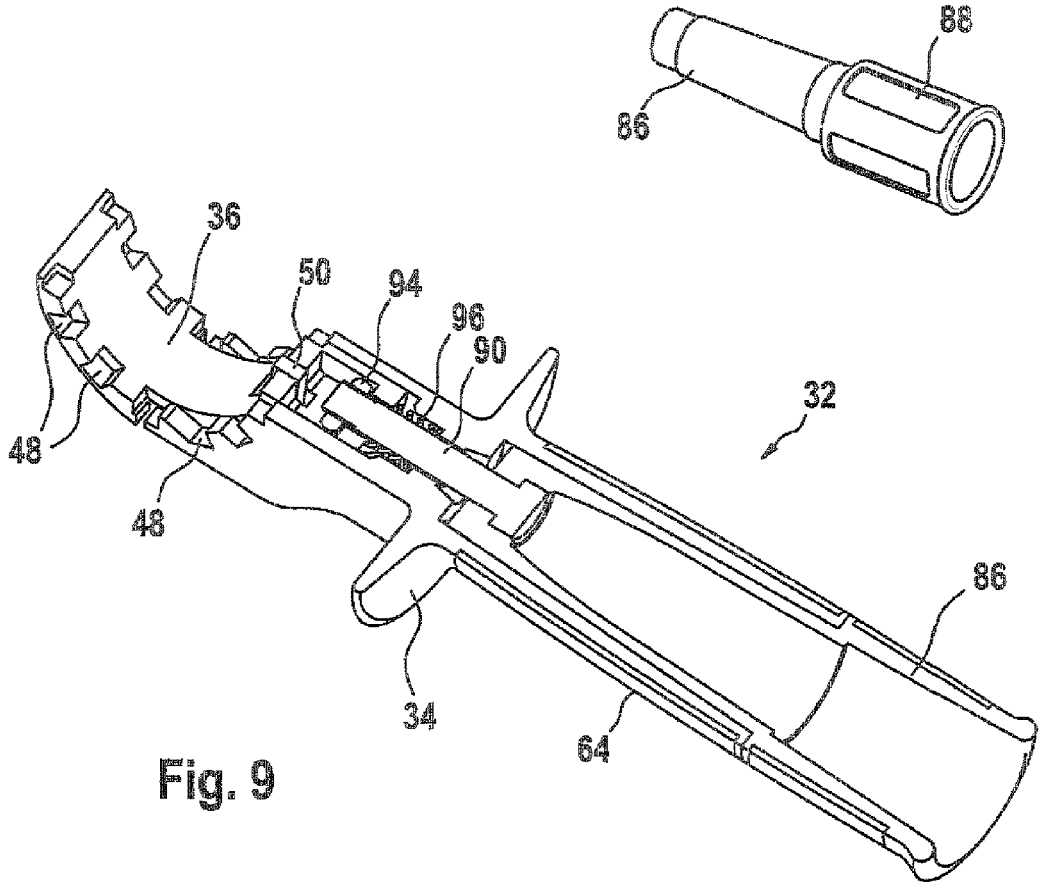
FIG. 9 is a longitudinal section through the auxiliary handle from FIG. 8 in the assembled state.

FIGS. 8 and 9 show an alternative embodiment of the auxiliary handle 32. For features and functions that remain the same, the reader can refer to the description of the exemplary embodiment in FIGS. 1 through 7. Components and features that essentially correspond have basically been labeled with the same reference numerals. The following description of FIGS. 8 and 9 will be essentially limited to the differences in relation to the exemplary embodiment in FIGS. 1 through 7.

The second component 36 has the fastening means 18 for producing a form-locked connection in the circumference direction 20. The recesses 48 extend along a subregion 56 of the receiving element 76 of the second component 36 in the circumference direction 20; in the assembled state, the subregion 56 with the recesses 48 transitions into the recesses 48 of the first component 34. In addition, the rib-shaped fastening element 50 of the first component 34 is composed of a stamped sheet metal part.

The auxiliary handle 32 in FIGS. 8 and 9 has a third component 86 for clamping the first component 34 to the second component 36. To this end, the third component 86 has a handle element 88 that is inserted into the first component 34 in rotatable fashion and is screwed to the second component 36 by means of a threaded rod 90 shown in FIG. 9. For this purpose, the subregion 74 of the second component 36 includes a recess 92 into which a nut 94 is inserted. The nut 94 is provided with a rotation prevention means and is integrated in a form-locked fashion into a plastic wall of the subregion 74 of the second component 36. In addition, the cavity 82 of the first component 34 contains a spring 96 that is situated around the threaded rod 90 of the third component 86 and is prestressed when the auxiliary handle 32 is in the assembled state. If the screw connection to the second component 36 is detached by rotation of the third component 86, then a spring force of the spring 96 causes the second component 36 to be pushed out of the first component 34 and the rib-shaped fastening element 50 is released from the groove-shaped recess 42 of the spindle neck 44; the auxiliary handle 32 can then be removed from the spindle neck 44 of the hand-held power tool 12.

It is also essentially conceivable for the rib-shaped fastening element 50 to be spring-loaded so that when the auxiliary handle 32 is mounted in place, the rib-shaped fastening element 50 engages in detent fashion in the groove-shaped recess 42 of the spindle neck 44 as soon as the auxiliary handle 32 is connected in form-locked fashion to the spindle neck 44 in the circumference direction 20.

The foregoing relates to the preferred exemplary embodiments of the invention, it being understood that other variants and embodiments thereof are possible within the spirit and scope of the invention, the latter being defined by the appended claims.

The invention claimed is:

1. An auxiliary handle device for providing a removable auxiliary handle which can be added to a hand-held power tool so that an operator can grasp the auxiliary handle when the auxiliary handle device is connected to the hand-held power tool, the auxiliary handle device being connected to the hand-held power tool along a fastening axis which is parallel to a working axis of the hand-held power tool, the auxiliary handle device having a fastening device that has at least one first fastening means, the first fastening means including a groove-shaped recess on the hand-held power tool which extends in a circumferential direction, the first fastening means further including a fastening element in the auxiliary handle which engages the groove-shaped recess so that the first fastening means provide a form-locked connection along the fastening axis, the fastening device also including a second fastening means which has at least one bar-shaped raised area on the hand-held power tool, wherein the second fastening means also has at least one recess in the auxiliary handle which can engage with the at least one bar shaped raised area so that when the auxiliary handle is attached to the hand-held power tool the second fastening means holds said handle in one of a plurality of preset rotational positions about the fastening axis, the auxiliary handle having two handle parts, both of which can be grasped by the operator during use, wherein one of the handle parts is rotatable with respect to the other handle part, and wherein the rotatable handle part includes a threaded connector which is at least partially positioned within the other handle part and are operable so that when the rotatable handle part is rotated the threaded connector causes the fastening element to be forced into the groove-shaped recess and thus lock the auxiliary handle device onto the hand-held power tool.

2. The auxiliary handle device as recited in claim 1, wherein the fastening element is rib-shaped.

3. The auxiliary handle device as recited in claim 2, wherein said other handle part has a hollow portion, and the rib-shaped fastening element is situated inside the hollow portion.

4. The auxiliary handle device as recited in claim 2, wherein the groove-shaped recess is situated in a spindle neck of a hand-held power tool.

5. The auxiliary handle device as recited in claim 1, wherein the groove-shaped recess is situated in a spindle neck of a hand-held power tool.

6. The auxiliary handle device as recited in claim 1, wherein the at least one bar-shaped raised area is situated on a spindle neck of a hand-held power tool.

7. The auxiliary handle device as recited in claim 1, wherein the fastening device is embodied by a first component and a second component which engage with each other in a form-locked fashion in the assembled state.

8. The auxiliary handle device as recited in claim 7, wherein at least a subregion of one of the components of the auxiliary handle is embodied as slot-shaped.

9. The auxiliary handle device as recited in claim 7, wherein at least a subregion of one of the components of the auxiliary handle has a cavity.

* * * * *